US010099342B2

(12) United States Patent
Watanabe

(10) Patent No.: US 10,099,342 B2
(45) Date of Patent: Oct. 16, 2018

(54) TRUER, TRUING APPARATUS INCLUDING TRUER, GRINDER, AND TRUING METHOD

(71) Applicant: JTEKT CORPORATION, Osaka-shi (JP)

(72) Inventor: Akira Watanabe, Chiryu (JP)

(73) Assignee: JTEKT CORPORATION, Osaka-shi (JP)

( * ) Notice: Subject to any disclaimer, the term of this patent is extended or adjusted under 35 U.S.C. 154(b) by 73 days.

(21) Appl. No.: 15/373,527

(22) Filed: Dec. 9, 2016

(65) Prior Publication Data

US 2017/0165806 A1 Jun. 15, 2017

(30) Foreign Application Priority Data

Dec. 14, 2015 (JP) ..... 2015-243638

(51) Int. Cl.
*B24B 53/12* (2006.01)

(52) U.S. Cl.
CPC ..... *B24B 53/12* (2013.01)

(58) Field of Classification Search
CPC ..... B24B 53/12; B24D 7/18; B24D 5/123; B24D 5/12; B24D 1/041; B23D 1/18
USPC ..... 451/540–547
See application file for complete search history.

(56) References Cited

U.S. PATENT DOCUMENTS 1,103,631 A * 7/1914 Stott ..... B24B 37/042 451/41
3,168,799 A * 2/1965 Johnson ..... B24D 15/02 15/105
3,208,838 A * 9/1965 Fischer ..... B24D 18/0081 264/345
3,364,630 A * 1/1968 Rusk ..... B24D 7/02 451/490
3,896,593 A * 7/1975 Rine ..... B24D 7/04 451/546
3,898,772 A * 8/1975 Sawluk ..... B23C 5/00 451/547
4,246,004 A * 1/1981 Busch ..... B24D 99/005 451/542
4,492,059 A * 1/1985 Panetti ..... E01B 31/17 451/178
4,517,769 A * 5/1985 Fujimoto ..... B24B 19/02 257/E21.238

(Continued)

FOREIGN PATENT DOCUMENTS

JP 8-192359 7/1996
JP 2015-77650 4/2015

*Primary Examiner* — George Nguyen
(74) *Attorney, Agent, or Firm* — Oblon, McClelland, Maier & Neustadt, L.L.P.

(57) ABSTRACT

A truer includes: a core formed into a truncated cone; and an abrasive grain layer fixed onto an outer peripheral surface of the core. The core includes: a base that is a small-diameter portion of the truncated cone and has a disc shape; and a tubular member extending from an outer peripheral edge of the base in the direction in which a rotation axis of the truncated cone extends. The tubular member has a hollow tubular shape. The tubular member includes an outer peripheral surface tapered so that a portion of the tubular member opposite to the base and adjacent to an extremity of the tubular member is a large-diameter portion of the truncated cone. A recess opening toward the extremity is defined inward of the tubular member.

10 Claims, 8 Drawing Sheets

(56) References Cited

U.S. PATENT DOCUMENTS

| | | | | |
|---|---|---|---|---|
| 5,769,697 | A * | 6/1998 | Nishio | B24B 37/042 451/285 |
| 5,885,149 | A * | 3/1999 | Gillet | B24D 5/12 125/15 |
| 8,366,521 | B2 * | 2/2013 | Kim | B24D 3/28 451/546 |
| 8,512,098 | B1 * | 8/2013 | Bonner | B24B 19/022 451/28 |
| 2004/0198206 | A1 * | 10/2004 | Toge | B24B 53/017 451/547 |
| 2010/0236537 | A1 * | 9/2010 | Lanes | B24B 53/075 125/11.03 |
| 2011/0039479 | A1 * | 2/2011 | Beyer | B24B 53/12 451/56 |
| 2013/0331016 | A1 * | 12/2013 | Kimoto | B24D 7/066 451/548 |
| 2016/0236321 | A1 * | 8/2016 | Watanabe | B24B 53/06 |

* cited by examiner

TRUER, TRUING APPARATUS INCLUDING TRUER, GRINDER, AND TRUING METHOD

INCORPORATION BY REFERENCE

The disclosure of Japanese Patent Application No. 2015-243638 filed on Dec. 14, 2015 including the specification, drawings and abstract is incorporated herein by reference in its entirety.

BACKGROUND OF THE INVENTION

1. Field of the Invention

The invention relates to truers, truing apparatuses including truers, grinders, and truing methods.

2. Description of the Related Art

A truing apparatus known in the related art is configured to shape the grinding surface of a grinding wheel using a truer in order to machine a workpiece into a desired shape or maintain the machining efficiency of a grinding process. A truer (which may also be referred to as a "dresser") known in the related art and used for such a truing apparatus includes abrasive grains deposited on a core made of a metal material, such as iron or aluminum, by electrodeposition, for example. The abrasive grains on the truer are brought into contact with the grinding surface of a grinding wheel so as to slightly shave away the grinding surface, resulting in a new grinding surface having a desired shape.

Japanese Patent Application Publication No. 2015-77650 (JP 2015-77650 A) discloses a grinder including two disc-shaped truers protruding radially outward. The rotation axes of the two truers are perpendicular to each other. One of the truers effects truing on the outer peripheral surface of a grinding wheel, and the other truer effects truing on the end faces of the grinding wheel.

FIG. 7 of Japanese Patent Application Publication No. 8-192359 (JP 8-192359 A) illustrates a truer including diamond abrasive grains deposited on the outer peripheral surface of a truncated conical core that includes an edge. Using the diamond abrasive grains on the edge of the core of the truer, the outer peripheral surface and end faces of a grinding wheel are subjected to truing. First, the end face of the extremity of the truer is brought into contact with the outer peripheral cylindrical surface of the grinding wheel, and the truer is moved in parallel with the central line of the grinding wheel, thus effecting truing on the outer peripheral cylindrical surface of the grinding wheel using the abrasive grains on the edge. Subsequently, the truer is moved along the arc-shaped corner and the end face of the grinding wheel, thus effecting truing on the arc-shaped corner and the end face of the grinding wheel using the abrasive grains on the edge.

The grinder disclosed in JP 2015-77650 A requires the two truers. The number of truers is desirably one in order to reduce the size of the grinder. The truer disclosed in JP 8-192359 A enables truing on the outer peripheral surface and end faces of the grinding wheel by the single truer.

Unfortunately, effecting truing on the outer peripheral cylindrical surface of the grinding wheel using the truer disclosed in JP 8-192359 A brings a wide range of the end surface of the core into contact with the outer peripheral cylindrical surface of the grinding wheel. This significantly increases resistance during truing on the outer peripheral cylindrical surface of the grinding wheel. The increase in the resistance may move the truer itself away from the grinding wheel, causing the abrasive grains to shift from desired positions on the outer peripheral cylindrical surface of the grinding wheel. In such a case, the outer peripheral cylindrical surface of the grinding wheel may not be formed into a desired shape.

In effecting truing on the outer peripheral cylindrical surface of the grinding wheel, a truing method disclosed in JP 8-192359 A involves bringing the core into contact with the outer peripheral cylindrical surface of the grinding wheel before the abrasive grains come into contact with the outer peripheral cylindrical surface of the grinding wheel. This means that a force is exerted on the abrasive grains in a radially outward direction of the truer. Such a force may cause the abrasive grains to be separated from the core. If the abrasive grains are separated from the core in the course of truing on the outer peripheral cylindrical surface of the grinding wheel, the outer peripheral cylindrical surface will not be formed into a desired shape.

SUMMARY OF THE INVENTION

An object of the invention is to provide a truer capable of enhancing the accuracy of shaping of a grinding wheel, a truing apparatus including the truer, a grinder including the truing apparatus, and a truing method performed using the truer.

A truer according to an aspect of the invention effects truing on an end face and an outer peripheral surface of a grinding wheel. The truer includes a core and an abrasive grain layer. The core is formed into a truncated cone. The core is rotatable around a center line of the truncated cone. The abrasive grain layer is fixed onto an outer peripheral surface of the core. The core includes a base and a tubular member. The base is a small-diameter portion of the truncated cone. The base has a disc shape. The tubular member extends from an outer peripheral edge of the base in the direction in which the center line of the truncated cone extends. The tubular member has a hollow tubular shape. The tubular member includes an outer peripheral surface tapered so that a portion of the tubular member opposite to the base and adjacent to an extremity of the tubular member is a large-diameter portion of the truncated cone. A recess opening toward the extremity is defined inward of the tubular member.

The truncated conical core of the truer according to this aspect includes the hollow tubular member extending from the outer peripheral edge of the base in the direction in which the center line of the truncated cone extends. The recess opening toward the extremity of the core is defined inward of the tubular member. Thus, the extremity of the tubular member defining the end surface of the core has a substantially annular shape surrounding the recess. Because the end surface of the core to be brought into contact with the end face or outer peripheral surface of the grinding wheel has the substantially annular shape, the area of contact of the end surface of the core according to this aspect with the grinding wheel is smaller than the area of contact of the end surface of a conventional core with a grinding wheel. This reduces resistance during truing on the end face or outer peripheral surface of the grinding wheel. Consequently, this aspect reduces the possibility of a defective condition resulting from large resistance.

A truing apparatus according to an aspect of the invention includes the truer according to the above aspect, a mover, and a controller. The mover is configured to move the truer and the grinding wheel relative to each other. The controller is configured to control the mover. The controller causes the truer and the grinding wheel to have such relative positions that a rotation axis of the truer is perpendicular to a rotation axis of the grinding wheel, and the extremity of the tubular member faces toward the rotation axis of the grinding wheel. The controller includes an end face truing control unit and an outer peripheral cylindrical surface truing control unit. The end face truing control unit is configured to move the truer relative to the grinding wheel so that the truer moves in a radially outward direction of the grinding wheel, thus effecting truing on the end face of the grinding wheel. The outer peripheral cylindrical surface truing control unit is configured to move the truer relative to the grinding wheel so that the truer moves in parallel with the rotation axis of the grinding wheel, thus effecting truing on the outer peripheral cylindrical surface of the grinding wheel while contact of an outer peripheral edge of the extremity of the tubular member with the outer peripheral cylindrical surface precedes contact of an inner peripheral edge of the extremity of the tubular member with the outer peripheral cylindrical surface. With the truer and the grinding wheel having the relative positions, the truing on the outer peripheral cylindrical surface of the grinding wheel is effected after the truing on the end face of the grinding wheel.

A grinder according to an aspect of the invention includes the truing apparatus according to the above aspect.

A truing method according to an aspect of the invention is a truing method for effecting truing on the end face of the grinding wheel and the outer peripheral cylindrical surface of the grinding wheel using the truer according to the above aspect. The truing method includes: causing the truer and the grinding wheel to assume such relative positions that a rotation axis of the truer is perpendicular to a rotation axis of the grinding wheel, and the extremity of the tubular member faces toward the rotation axis of the grinding wheel; moving the truer relative to the grinding wheel so that the truer moves in a radially outward direction of the grinding wheel, thus effecting truing on the end face of the grinding wheel; and moving the truer relative to the grinding wheel so that the truer moves in parallel with the rotation axis of the grinding wheel, thus effecting truing on the outer peripheral cylindrical surface of the grinding wheel while contact of an outer peripheral edge of the extremity of the tubular member with the outer peripheral cylindrical surface precedes contact of an inner peripheral edge of the extremity of the tubular member with the outer peripheral cylindrical surface. The truing on the outer peripheral cylindrical surface of the grinding wheel is effected after the truing on the end face of the grinding wheel.

The truing apparatus, the grinder, and the truing method according to the above aspects effect truing on the outer peripheral cylindrical surface of the grinding wheel while contact of the outer peripheral edge of the extremity of the tubular member with the outer peripheral cylindrical surface precedes contact of the inner peripheral edge of the extremity of the tubular member with the outer peripheral cylindrical surface. Thus, a force is exerted on abrasive grains in a radially inward direction of the truer. This force makes it difficult for the abrasive grains to be separated from the core. Consequently, the truing apparatus, the grinder, and the truing method according to the above aspects not only enhance the accuracy of shaping of the grinding wheel by truing but also increase the life of the truer.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
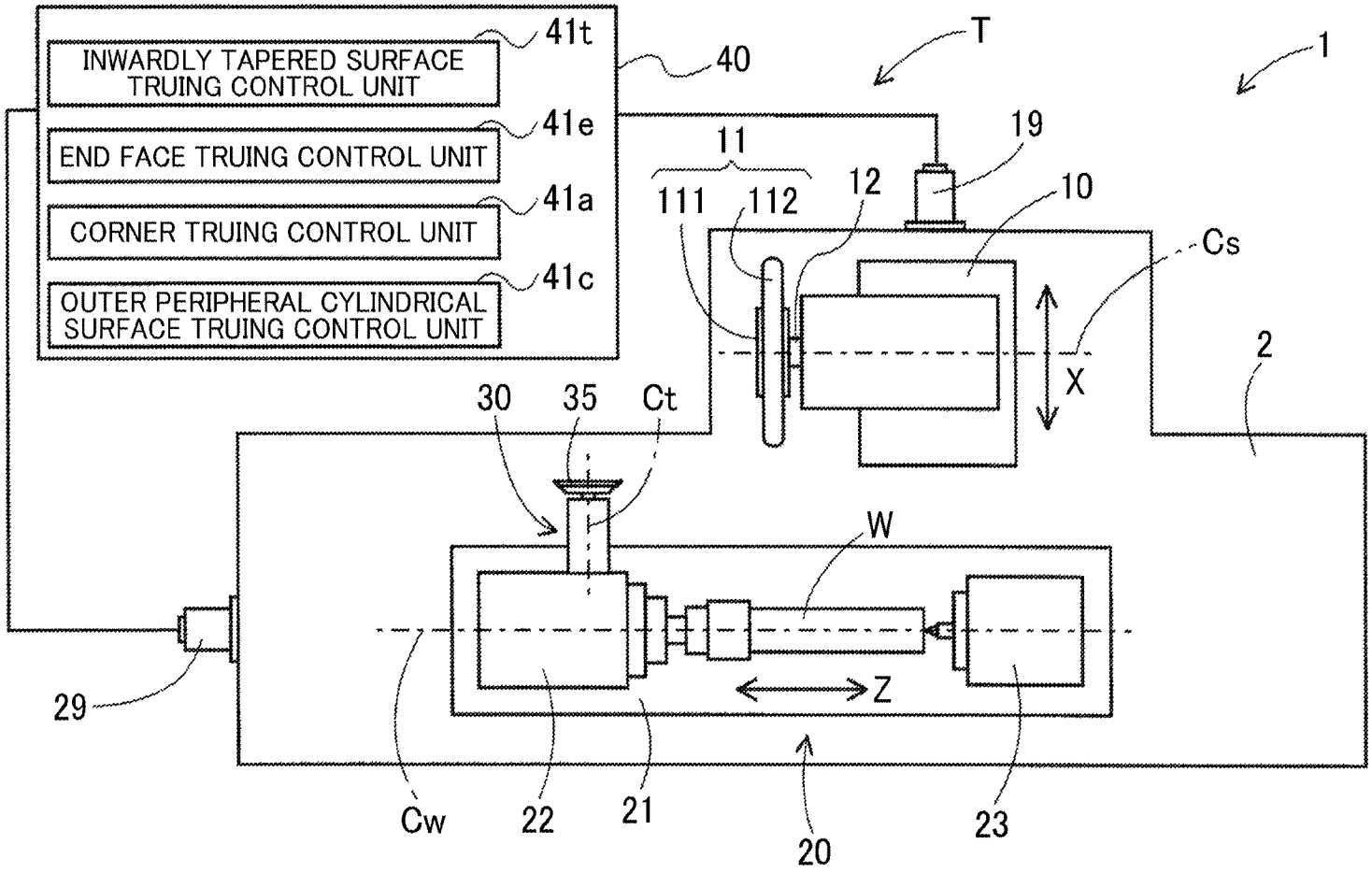
FIG. 1 is a schematic diagram illustrating a grinder according to an embodiment of the invention.

The arrangement of a grinder 1 will be described with reference to FIG. 1. The grinder 1 is a machine tool to move a grinding wheel 11 relative to a workpiece W supported on a bed 2, thus grinding the workpiece W. The grinder 1 mainly includes the bed 2, a wheel spindle stock 10, the grinding wheel 11, a workpiece supporting device 20, a truer unit 30, and a controller 40.

The wheel spindle stock 10 is disposed on the upper surface of the bed 2. The wheel spindle stock 10 is movable relative to the bed 2 in a direction perpendicular to a central axis Cw of the workpiece W. This direction corresponds to an X-axis direction. The wheel spindle stock 10 is moved in the X-axis direction by an X-axis driving device 19. The X-axis driving device 19 includes a servomotor and a feed screw. The wheel spindle stock 10 includes a rotatable grinding wheel spindle 12.

The grinding wheel 11 has a disc shape. The grinding wheel 11 includes a grinding wheel core 111 and a grindstone 112. The grinding wheel core 111 according to this embodiment is a disc-shaped core made of metal, such as iron or aluminum. The grinding wheel core 111 is detachably coupled to the grinding wheel spindle 12 with a fastener, such as a bolt. The grindstone 112 has an annular shape. The grindstone 112 is fixed to the outer peripheral surface of the grinding wheel core 111. The grindstone 112 comes into contact with the workpiece W during grinding. In one example, the grindstone 112 is provided, for example, by bonding superhard CBN abrasive grains to the outer periphery of the grinding wheel core 111 with a vitrified bond, for example.

The workpiece supporting device 20 supports the ends of the workpiece W such that the workpiece W is rotatable around the central axis Cw of the workpiece W. The workpiece supporting device 20 includes a table 21, a spindle stock 22, and a tail stock 23. The table 21 is disposed on the upper surface of the bed 2 so that the table 21 is movable in a Z-axis direction. The Z-axis direction corresponds to the central axis Cw of the workpiece W. The table 21 is moved in the Z-axis direction by a Z-axis driving device 29. The Z-axis driving device 29 includes a servomotor and a feed screw.

The spindle stock 22 and the tail stock 23 are disposed on the upper surface of the table 21 so that the spindle stock 22 and the tail stock 23 face each other along the central axis Cw of the workpiece W. The spindle stock 22 and the tail stock 23 each support an associated one of the ends of the workpiece W such that the workpiece W is rotatable. The spindle stock 22 includes a spindle that is rotated by a driving device (not illustrated). Rotation of the spindle of the spindle stock 22 causes the workpiece W to rotate, with the workpiece W supported by the spindle stock 22 and the tail stock 23.

The truer unit 30 is fixed to a lateral surface of the spindle stock 22 to be brought close to the wheel spindle stock 10. The truer unit 30 includes a rotatably supported truer 35, and a driving device to rotate the truer 35. The truer 35 effects truing on the grindstone 112 of the grinding wheel 11 while being rotated so that the grindstone 112 is formed into a desired shape.

The controller 40 includes a central processing unit (CPU) and a read-only memory (ROM). The controller 40 stores, for example, a numerical control (NC) program, grinding conditions, and truing conditions. In carrying out grinding, the controller 40 numerically controls the position of the wheel spindle stock 10 along the X-axis, the position of the table 21 along the Z-axis, and the rotation of the workpiece W. The grinder 1 is configured so that the controller 40 controls the positions of the wheel spindle stock 10 along the X- and Z-axes relative to the workpiece W while rotating the grinding wheel 11, thus grinding the outer peripheral surface of the workpiece W.

In effecting truing, the controller 40 controls the rotation of the truer 35 by rotating a motor of the truer unit 30. The controller 40 further numerically controls the position of the wheel spindle stock 10 along the X-axis and the position of the truer 35 along the Z-axis, thus effecting truing so as to form the grinding wheel 11 into a desired shape.

A truing apparatus T according to an embodiment of the invention includes the truer unit 30, the X-axis driving device 19, the Z-axis driving device 29, and the controller 40. The X-axis driving device 19 and the Z-axis driving device 29 function as a mover to move the grinding wheel 11 and the truer unit 30 relative to each other.

Figure 2:
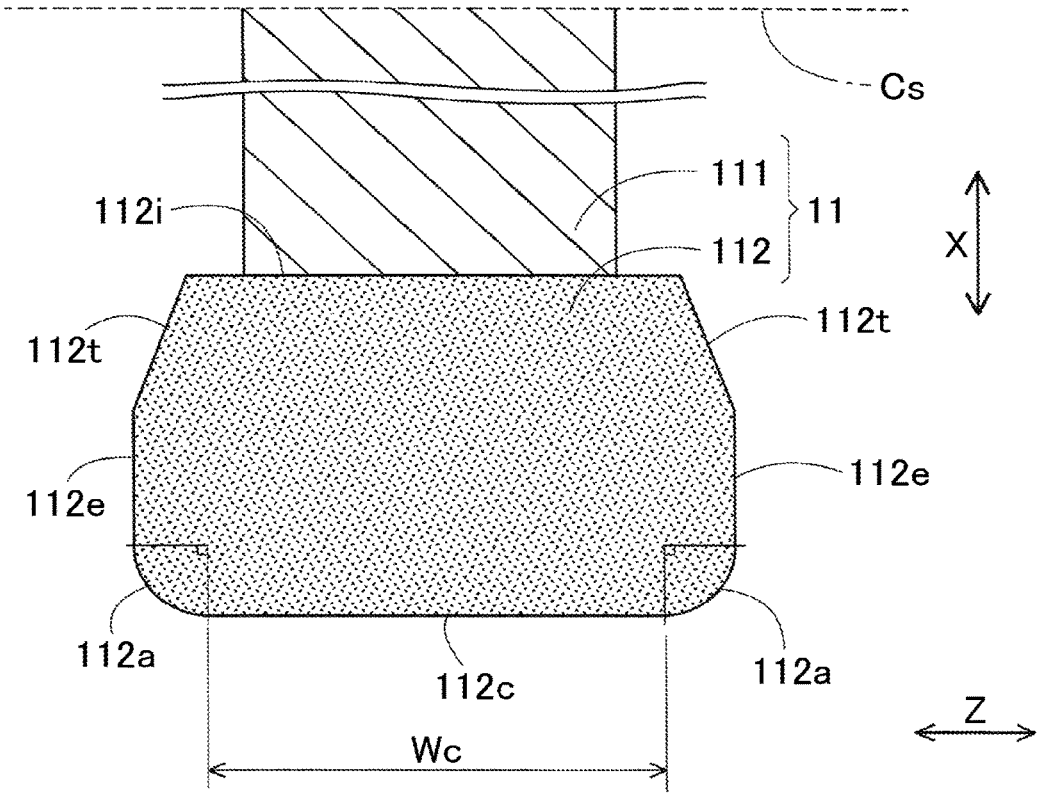
FIG. 2 is a cross-sectional view of a grinding wheel of the grinder in FIG. 1 taken along a plane extending along the rotation axis of the grinding wheel, mainly illustrating a grindstone of the grinding wheel.

The shape of the grindstone 112 of the grinding wheel 11 will be described with reference to FIG. 2. FIG. 2 illustrates a cross section of the grindstone 112 taken along a plane extending along a rotation axis Cs of the grindstone 112. This cross section will hereinafter be referred to as a "vertical cross section" of the grindstone 112. The vertical cross section of the grindstone 112 includes: an outer peripheral cylindrical surface 112*c* defining the outer peripheral surface of the grindstone 112; two corners 112*a*, 112*a*; two end faces 112*e*, 112*e*; an inner peripheral cylindrical surface 112*i* defining the inner peripheral surface of the grindstone 112; and two inwardly tapered surfaces 112*t*, 112*t*.

The outer peripheral cylindrical surface 112*c* defines the outer peripheral surface of the grinding wheel 11 (or more specifically, the grindstone 112) and is parallel to the rotation axis Cs of the grindstone 112. The outer peripheral cylindrical surface 112*c* has a width Wc. Each end face 112*e* is a surface perpendicular to the rotation axis Cs of the grindstone 112. Each corner 112*a* is formed between the outer peripheral cylindrical surface 112*c* and an associated one of the end faces 112*e*. In this embodiment, each corner 112*a* is arc-shaped in cross section in FIG. 2. Each corner 112*a* is connected to the outer peripheral cylindrical surface 112*c* and the associated end face 112*e* so that tangents to each corner 112*a* are continuous with the outer peripheral cylindrical surface 112*c* and the associated end face 112*e*. In other words, each corner 112*a* has a central angle of 90°. The outer peripheral cylindrical surface 112*c*, the end faces 112*e*, and the corners 112*a* each serve as a surface to be brought into contact with the workpiece W when appropriate so as to grind the workpiece W.

The inner peripheral cylindrical surface 112*i* is parallel to the rotation axis Cs and bonded to the outer peripheral surface of the grinding wheel core 111. Each inwardly tapered surface 112*t* connects the inner peripheral cylindrical surface 112*i* with the associated end face 112*e*. Each inwardly tapered surface 112*t* is provided in order to bring the radial length of the associated end face 112*e* within a predetermined range. This is because bringing the radial length of each end face 112*e* within a predetermined range keeps grinding resistance within a predetermined range when the workpiece W is subjected to grinding using the end face 112*e*. In other words, each inwardly tapered surface 112*t* functions as a flank when the workpiece W is subjected to grinding using the associated end face 112*e*.

The structure of the truer unit 30 will be described with reference to FIG. 3. The truer unit 30 includes: a cylindrical housing 34; a truer shaft 33 rotatable by a motor (not illustrated); and the truer 35 fixed to an end of the truer shaft 33.

The truer shaft 33 is rotatably provided inside the cylindrical housing 34. The truer shaft 33 includes a circular cylindrical protrusion 33*a* protruding axially from the center of the end surface of the truer shaft 33. A portion of the end surface of the truer shaft 33 radially outward of the protrusion 33*a* is provided with a plurality of internal threads into which bolts are to be screwed.

The truer 35 is detachably attached to the end surface of the truer shaft 33 with the bolts. The truer 35 is formed into a truncated cone. The small-diameter portion of the truncated cone, i.e., the truer 35, includes a base end to be fixed to the end surface of the truer shaft 33. The large-diameter portion of the truncated cone, i.e., the truer 35, includes an extremity to be located opposite to the truer shaft 33. The truer 35 includes a core 31 and an abrasive grain layer 32.

The core 31 is made of a metal material, such as iron or aluminum. The core 31 is formed into a truncated cone. In the cross section taken along a plane extending along a rotation axis Ct of the core 31, the core 31 has a cup shape whose upper end is increased in diameter. The core 31 includes a base 311 and a hollow tubular member 312. The base 311 is the small-diameter portion of the truncated cone corresponding to the bottom of the cup shape. The tubular member 312 is the large-diameter portion of the truncated cone corresponding to the peripheral wall of the cup shape. The abrasive grain layer 32 is provided on the outer periphery of the tubular member 312 of the core 31. The abrasive grain layer 32 is provided by depositing abrasive grains, such as granulated diamond, on the outer periphery of the tubular member 312 by electrodeposition, for example.

The shapes of the base 311 and the tubular member 312 of the core 31, and the shape of the abrasive grain layer 32 will be described below in detail.

The base 311 has a disc shape that defines the slightly thick bottom wall of the cup shape. The base 311 is provided in its center with a central hole 313. The protrusion 33*a* of the truer shaft 33 is fitted into the central hole 313. The base 311 is further provided with a plurality of bolt holes 314 located outward of the central hole 313. The bolts to be screwed into the internal threads of the truer shaft 33 are inserted into the bolt holes 314. Thus, the core 31 is rotatable around the rotation axis Ct that is the center line of the core 31.

The tubular member 312 extends from the outer peripheral edge of the base 311 in the direction in which the rotation axis Ct of the core 31 extends. The tubular member 312 includes a tapered outer peripheral surface 312*d*. The outer peripheral surface 312*d* of the tubular member 312 and the outer peripheral surface of the base 311 are continuous with each other without any joint therebetween so as to define the conical surface of the core 31.

The tubular member 312 further includes: a base portion 312*a* that is a portion of the tubular member 312 connected to the base 311; and an extremity 312*b* that is an extremity of the tubular member 312 located opposite to the base 311. The base portion 312*a* is included in the small-diameter portion of the truncated cone. The extremity 312*b* is included in the large-diameter portion of the truncated cone. Because the tubular member 312 has a hollow tubular shape, the tubular member 312 further includes an inner peripheral surface 312*e*. Thus, the tubular member 312 defines a recess 312*f* located inward of the tubular member 312 and opened toward the extremity 312*b* of the tubular member 312. Specifically, the recess 312*f* is defined by the inner peripheral surface 312*e* of the tubular member 312 and the surface of the base 311. A corner formed between the extremity 312*b* and the outer peripheral surface 312*d* of the tubular member 312 defines an outer peripheral edge 312$b_1$. A corner formed between the extremity 312*b* and the inner peripheral surface 312*e* of the tubular member 312 defines an inner peripheral edge 312$b_2$.

The inner peripheral surface 312*e* of the tubular member 312 increases in diameter in a tapered manner as the inner peripheral surface 312*e* extends from the base portion 312*a* to the extremity 312*b*. The radial thickness of the tubular member 312 across its entire length is smaller than the radial length of the base 311. As illustrated in FIG. 3, the base portion 312*a* has a radial thickness Ta, and the extremity 312*b* has a radial thickness Tb. The radial thickness Ta and the radial thickness Tb have a relationship represented by the following expression:

$$Tb>Ta \tag{1}$$

This means that the radial thickness Tb of the extremity 312*b* of the tubular member 312 is larger than the radial thickness Ta of the base portion 312*a* of the tubular member 312. The radial thickness of the tubular member 312 gradually increases as the tubular member 312 extends from the base portion 312*a* to the extremity 312*b*.

Figure 3:
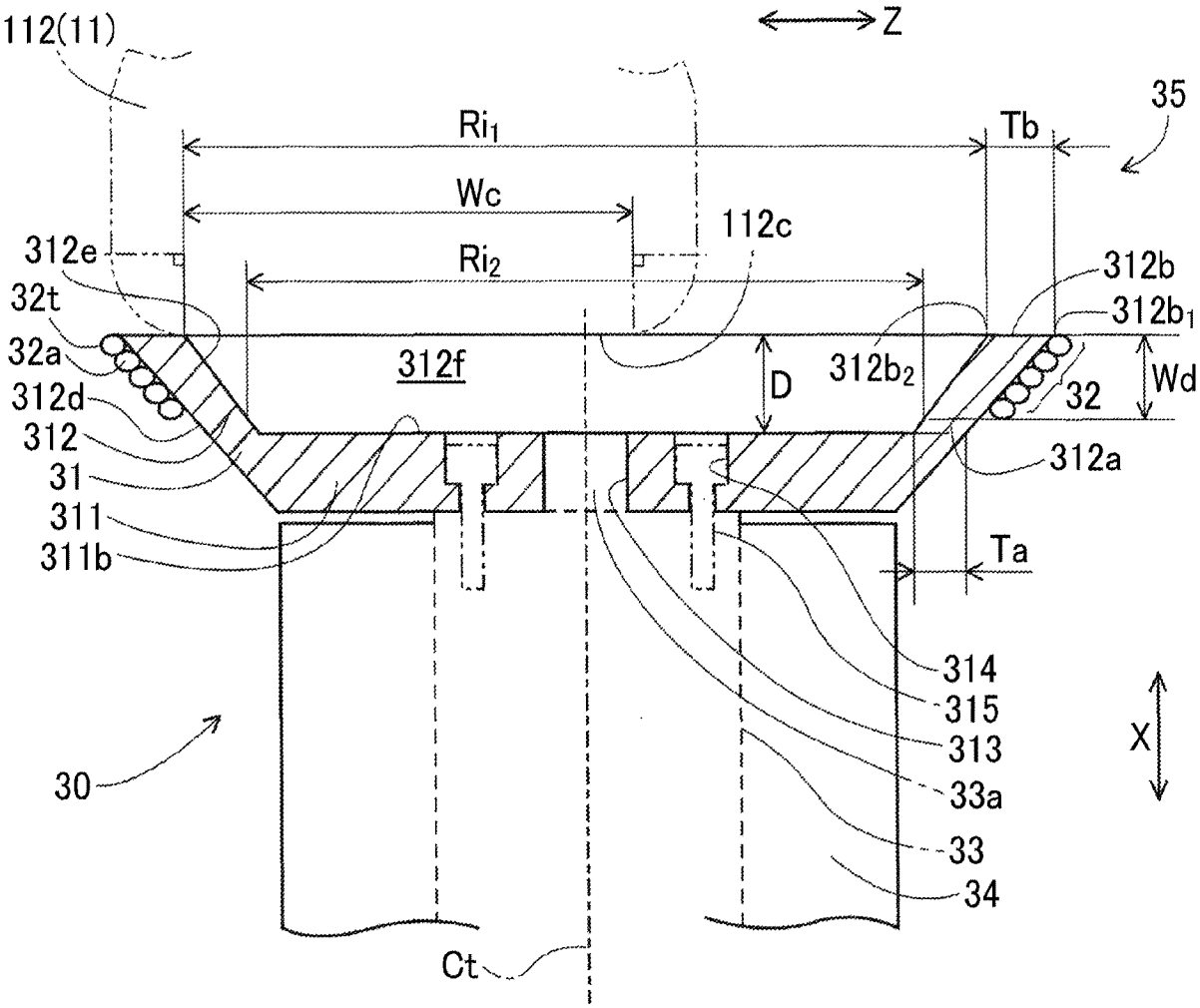
FIG. 3 is a cross-sectional view of a truer of the grinder in FIG. 1 taken along a plane extending along the rotation axis of the truer.

As illustrated in FIG. 3, the abrasive grain layer 32 is formed across a width Wd so that the abrasive grain layer 32 extends along the outer peripheral surface of the tubular member 312 from the extremity 312*b* toward the rotation axis Ct. As illustrated in FIG. 3, the recess 312*f* has a depth D. The width Wd of the abrasive grain layer 32 and the depth D of the recess 312*f* have a relationship represented by the following expression:

$$D>Wd \tag{2}$$

This means that the depth D of the recess 312*f* is larger than the width Wd of the abrasive grain layer 32. Thus, the abrasive grain layer 32 is not formed across the entire axial length of the outer peripheral surface of the tubular member 312 but is formed across a portion of the outer peripheral surface of the tubular member 312 extending from the extremity 312*b*.

As illustrated in FIG. 3, the extremity 312*b* of the tubular member 312 has an inside diameter $Ri_1$, and a portion of the tubular member 312 where abrasive grains 32*a* of the abrasive grain layer 32 closest to the base 311, i.e., closest to the rotation axis Ct, are located has an inside diameter $Ri_2$. The inside diameter $Ri_1$, the inside diameter $Ri_2$, and the width We of the outer peripheral cylindrical surface 112*c* of the grindstone 112 (see FIG. 2) have a relationship represented by the following expression:

$$Ri_1>Ri_2>Wc \tag{3}$$

This means that the inside diameters $Ri_1$ and $Ri_2$ of the tubular member 312 are each larger than the width Wc of the outer peripheral cylindrical surface 112*c* of the grindstone 112.

The radial thickness Ta of the base portion 312*a* of the tubular member 312, the radial thickness Tb of the extremity 312*b*, and the width Wc of the outer peripheral cylindrical surface 112*c* of the grindstone 112 have a relationship represented by the following expressions:

$$Wc>Tb,Ta \tag{4}$$

This means that the radial thicknesses Ta and Tb of the tubular member 312 are each smaller than the width Wc of the outer peripheral cylindrical surface 112*c*.

The abrasive grain layer 32 is provided on the outer peripheral surface 312*d* of the tubular member 312. A portion 32*t* of the abrasive grain layer 32 closest to the extremity 312*b* of the tubular member 312 is used in effecting truing on the grinding wheel 11. This portion will hereinafter be referred to as an "extremity portion 32*t*" of the abrasive grain layer 32. As truing is effected, the tubular member 312 wears out, and the abrasive grains 32*a* of the abrasive grain layer 32 fall off or wear away. This means that although the extremity portion 32*t* of the abrasive grain layer 32 will always be located adjacent to the extremity 312*b* of the tubular member 312, the position of the extremity portion 32*t* of the abrasive grain layer 32 will change.

Referring to FIG. 1, the following description discusses how the controller 40 functions during truing. In effecting truing, the controller 40 exercises control as previously described. Specifically, the controller 40 controls the position of the wheel spindle stock 10 along the X-axis and the position of the truer 35 along the Z-axis while rotating the truer 35 and the grinding wheel 11. The functional configuration of the controller 40 is as follows. The controller 40 includes an end face truing control unit 41*e*, an outer peripheral cylindrical surface truing control unit 41*c*, a corner truing control unit 41*a*, and an inwardly tapered surface truing control unit 41*t*. The end face truing control unit 41*e* controls truing on the end faces 112*e* of the grindstone 112 of the grinding wheel 11. The outer peripheral cylindrical surface truing control unit 41*c* controls truing on the outer peripheral cylindrical surface 112*c*. The corner truing control unit 41*a* controls truing on the corners 112*a*. The inwardly tapered surface truing control unit 41*t* controls truing on the inwardly tapered surfaces 112*t*.

Figure 4:
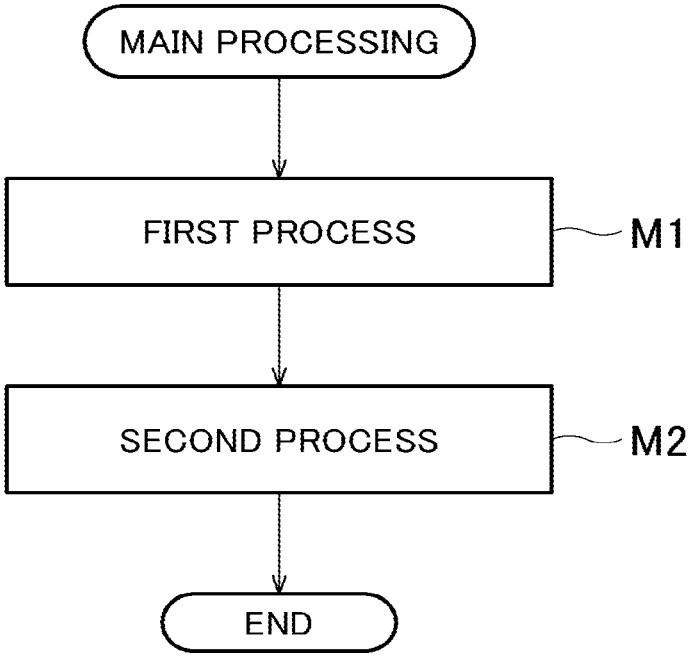
FIG. 4 is a flowchart illustrating an overall procedure to be performed by a controller of the grinder in FIG. 1.

A procedure to be performed by the controller 40 will be described below with reference to FIGS. 4 to 8. As illustrated in FIG. 4, the controller 40 performs a first process (i.e., step M1) involving truing on the right inwardly tapered surface 112*t*, the right end face 112*e*, the right corner 112*a*, and the outer peripheral cylindrical surface 112*c* of the grindstone 112 illustrated in FIG. 2. The controller 40 subsequently performs a second process (i.e., step M2) involving truing on the left inwardly tapered surface 112*t*, the left end face 112*e*, and the left corner 112*a* of the grindstone 112 illustrated in FIG. 2.

Figure 5:
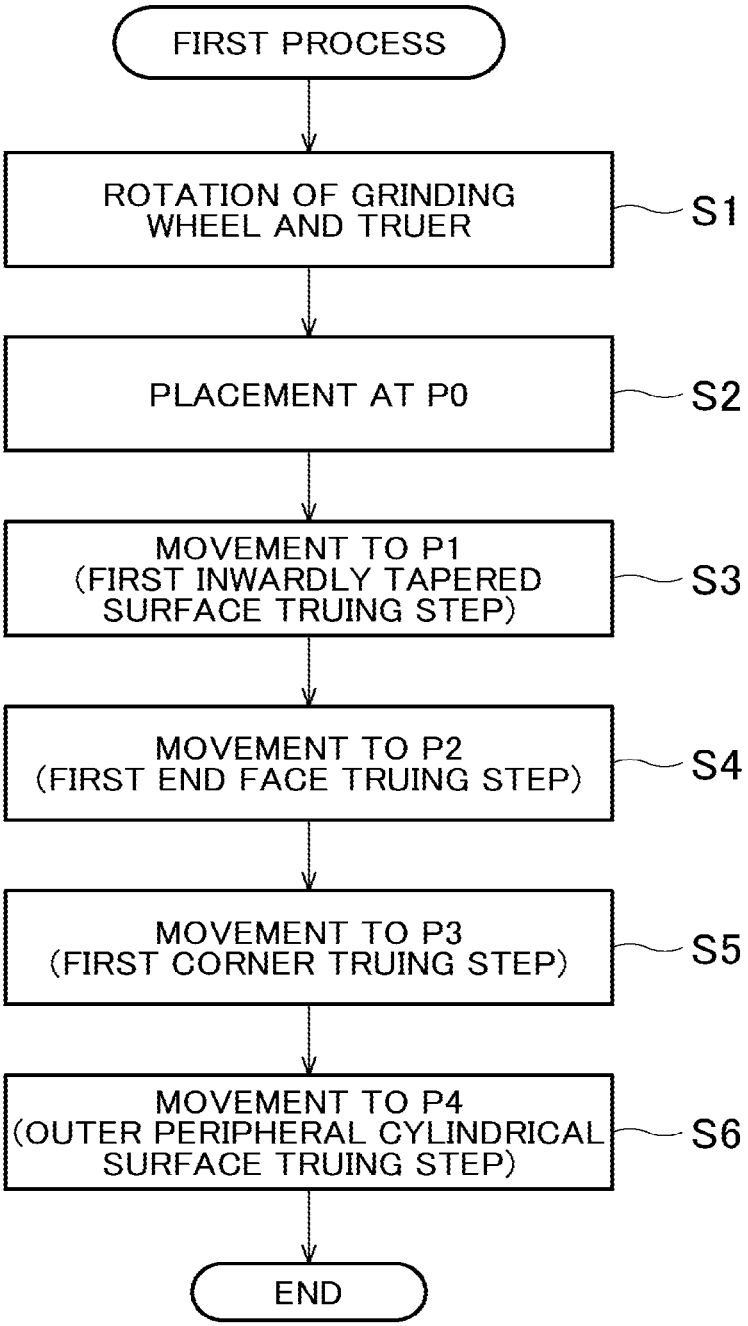
FIG. 5 is a flowchart illustrating a first process to be performed by the controller.
Figure 6:
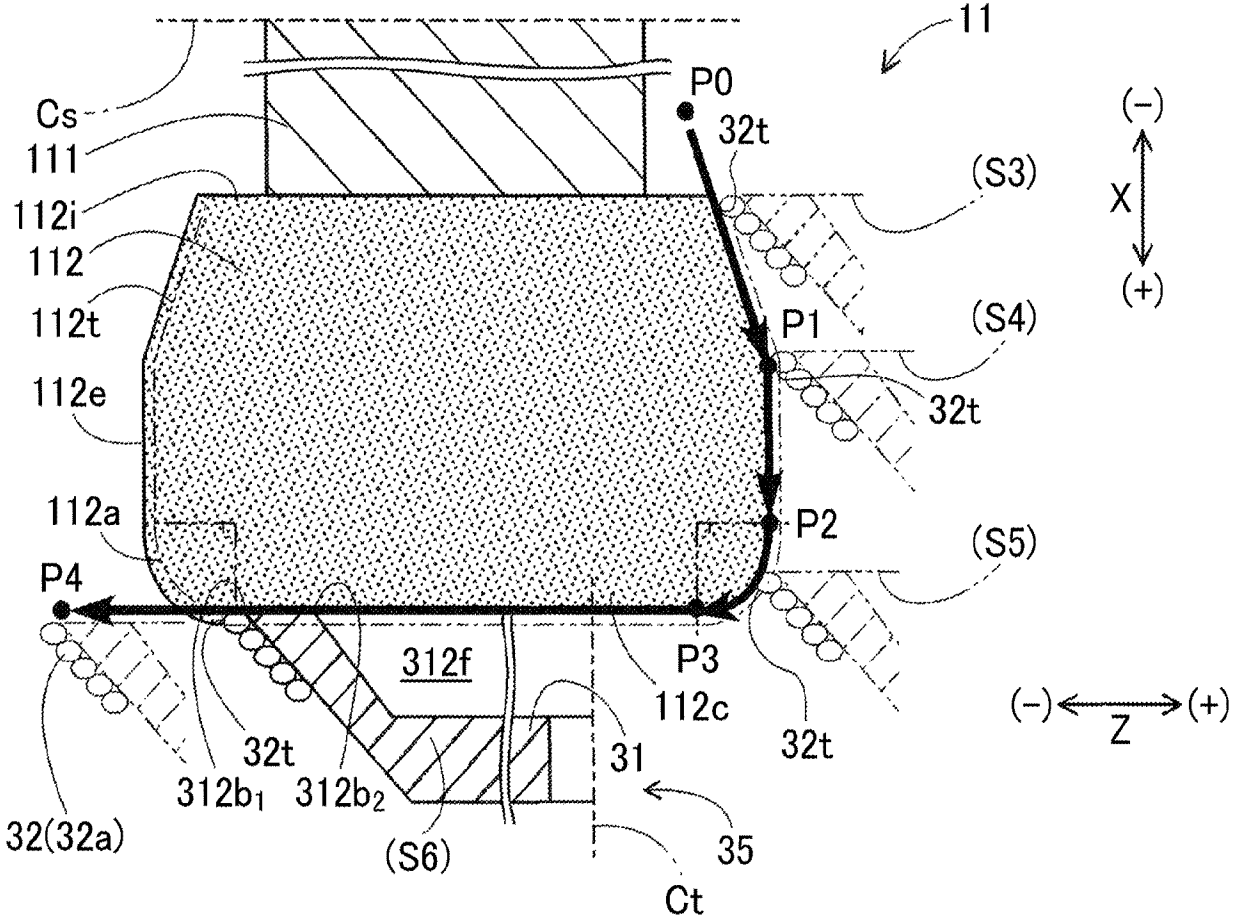
FIG. 6 is a diagram illustrating how the truer moves relative to the grinding wheel during the first process.

The first process to be performed by the controller 40 will be described with reference to FIGS. 5 and 6. In effecting truing, the controller 40 causes the truer 35 and the grinding wheel 11 to have such relative positions that the rotation axis Ct of the truer 35 and the rotation axis Cs of the grinding wheel 11 are perpendicular to each other, and the extremity 312*b* of the tubular member 312 of the truer 35 faces toward the rotation axis Cs of the grinding wheel 11. The relative positions of the truer 35 and the grinding wheel 11 are maintained until the end of the truing operation.

In step S1, the controller 40 rotates the grinding wheel 11 and the truer 35. Then, with the grinding wheel 11 and the truer 35 rotated, the controller 40 causes the truer 35 to move relative to the grinding wheel 11 so that the truer 35 faces one of the end faces 112*e* of the grinding wheel 11. In step S2, the controller 40 causes the extremity portion 32*t* of the abrasive grain layer 32 to move relative to the grinding wheel 11 so that the extremity portion 32*t* comes to a position P0 illustrated in FIG. 6. The position P0 is located on a radially inward extension of the inwardly tapered surface 112*t* after being subjected to truing. As previously mentioned, the extremity portion 32*t* of the abrasive grain layer 32 is located adjacent to the extremity 312*b* of the tubular member 312 and is used in effecting truing on the grinding wheel 11.

In step S3, the inwardly tapered surface truing control unit 41*t* of the controller 40 causes the extremity portion 32*t* of the abrasive grain layer 32 to move relative to the grinding wheel 11 so that the extremity portion 32*t* moves from the position P0 to a position P1, thus effecting truing on the inwardly tapered surface 112*t*. This step will also be referred to as a "first inwardly tapered surface truing step". The position P1 is located on the boundary between the inwardly tapered surface 112*t* after being subjected to truing and the end face 112*e*. In other words, the extremity portion 32*t* of the abrasive grain layer 32 moves linearly along the inwardly tapered surface 112*t*. Thus, the extremity portion 32*t* of the abrasive grain layer 32 effects truing on the inwardly tapered surface 112*t*. During this step, the extremity portion 32*t* of the abrasive grain layer 32 is located between the extremity 312*b* of the tubular member 312 of the core 31 and a portion of the inwardly tapered surface 112*t* of the grindstone 112 to be subjected to truing immediately after the extremity portion 32*t* comes into contact with this portion of the inwardly tapered surface 112*t*. This means that the extremity portion 32*t* of the abrasive grain layer 32 is pressed against the inwardly tapered surface 112*t* in the direction of movement of the extremity portion 32*t*. Consequently, the abrasive grains 32*a* of the extremity portion 32*t* of the abrasive grain layer 32 are unlikely to fall off the outer peripheral surface 312*d* of the tubular member 312.

In step S4, the end face truing control unit 41*e* of the controller 40 causes the extremity portion 32*t* of the abrasive grain layer 32 to move relative to the grinding wheel 11 so that the extremity portion 32*t* moves from the position P1 to a position P2, thus effecting truing on the end face 112*e*. This step will also be referred to as a "first end face truing step". Shifting the direction of truing after truing on the inwardly tapered surface 112*t* and then effecting truing on the end face 112*e* may involve adjusting the direction of movement of the extremity portion 32*t* of the abrasive grain layer 32. The position P2 is located in the direction of the plus sign along the X-axis with respect to the position P1. The position P2 is located on the boundary between the end face 112*e* after being subjected to truing and the corner 112*a*. In other words, the extremity portion 32*t* of the abrasive grain layer 32 moves linearly along the end face 112*e*. Thus, the extremity portion 32*t* of the abrasive grain layer 32 effects truing on the end face 112*e*. During this step, the extremity portion 32*t* of the abrasive grain layer 32 is located between the extremity 312*b* of the tubular member 312 of the core 31 and a portion of the end face 112*e* of the grindstone 112 to be subjected to truing immediately after the extremity portion 32*t* comes into contact with this portion of the end face 112*e*. This means that the extremity portion 32*t* of the abrasive grain layer 32 is pressed against the end face 112*e* in the direction of movement of the extremity portion 32*t*. Consequently, the abrasive grains 32*a* of the extremity portion 32*t* of the abrasive grain layer 32 are unlikely to fall off the outer peripheral surface 312*d* of the tubular member 312.

In step S5, the corner truing control unit 41*a* of the controller 40 causes the extremity portion 32*t* of the abrasive grain layer 32 to move relative to the grinding wheel 11 so that the extremity portion 32*t* moves from the position P2 to a position P3, thus effecting truing on the corner 112*a*. This step will also be referred to as a "first corner truing step". The position P3 is located on the boundary between the corner 112*a* after being subjected to truing and the outer peripheral cylindrical surface 112*c*. The extremity portion 32*t* of the abrasive grain layer 32 moves along the arc-shaped corner 112*a*. Thus, the extremity portion 32*t* of the abrasive grain layer 32 effects truing on the corner 112*a*. During this step, the extremity portion 32*t* of the abrasive grain layer 32 is located between the extremity 312*b* of the tubular member 312 of the core 31 and a portion of the corner 112*a* of the grindstone 112 to be subjected to truing immediately after the extremity portion 32*t* comes into contact with this portion of the corner 112*a*. This means that the extremity portion 32*t* of the abrasive grain layer 32 is pressed against the corner 112*a* in the direction of movement of the extremity portion 32*t*. Consequently, the abrasive grains 32*a* of the extremity portion 32*t* of the abrasive grain layer 32 are unlikely to fall off the outer peripheral surface 312*d* of the tubular member 312.

In step S6, the outer peripheral cylindrical surface truing control unit 41*c* of the controller 40 causes the extremity portion 32*t* of the abrasive grain layer 32 to move relative to the grinding wheel 11 so that the extremity portion 32*t* moves from the position P3 to a position P4, thus effecting truing on the outer peripheral cylindrical surface 112*c* This step will also be referred to as an "outer peripheral cylindrical surface truing step". The position P4 is located in the direction of the minus sign along the Z-axis with respect to the position P3. The position P4 is located on an extension of the outer peripheral cylindrical surface 112*c*. In other words, the extremity portion 32*t* of the abrasive grain layer 32 moves linearly along the outer peripheral cylindrical surface 112*c*. Thus, the extremity portion 32*t* of the abrasive grain layer 32 effects truing on the outer peripheral cylindrical surface 112*c*.

During this step, the extremity portion 32*t* of the abrasive grain layer 32 is located between the extremity 312*b* of the tubular member 312 of the core 31 and a portion of the outer peripheral cylindrical surface 112*c* of the grindstone 112 to be subjected to truing immediately after the extremity portion 32*t* comes into contact with this portion of the outer peripheral cylindrical surface 112*c*. The extremity portion 32*t* of the abrasive grain layer 32 is pressed against the outer peripheral cylindrical surface 112*c* in the direction of movement of the extremity portion 32*t*. Turning attention to the extremity 312*b* of the tubular member 312, the abrasive grain layer 32 effects truing on the outer peripheral cylindrical surface 112*c* while contact of the outer peripheral edge 312$b_1$ of the extremity 312*b* of the tubular member 312 with the outer peripheral cylindrical surface 112*c* precedes contact of the inner peripheral edge 312$b_2$ of the extremity 312*b* of the tubular member 312 with the outer peripheral cylindrical surface 112*c*. Thus, the abrasive grains 32*a* of the extremity portion 32*t* of the abrasive grain layer 32 are unlikely to fall off the outer peripheral surface 312*d* of the tubular member 312. Upon completion of these steps, the controller 40 ends the first process.

Figure 7:
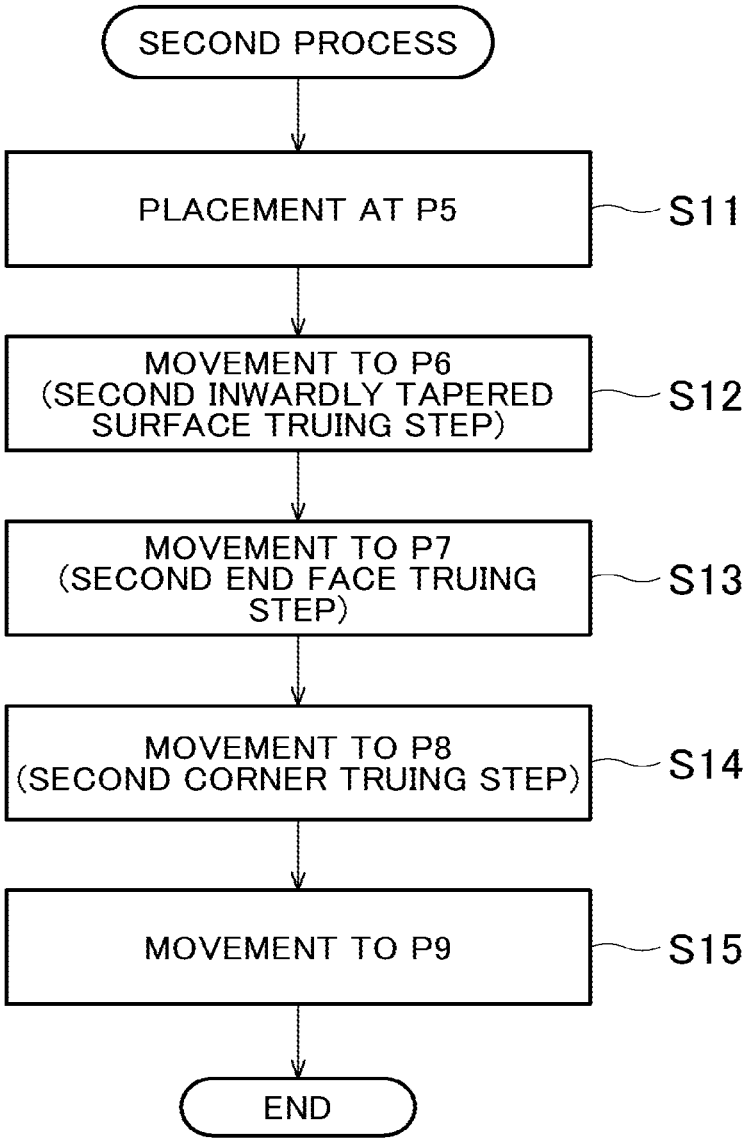
FIG. 7 is a flowchart illustrating a second process to be performed by the controller.
Figure 8:
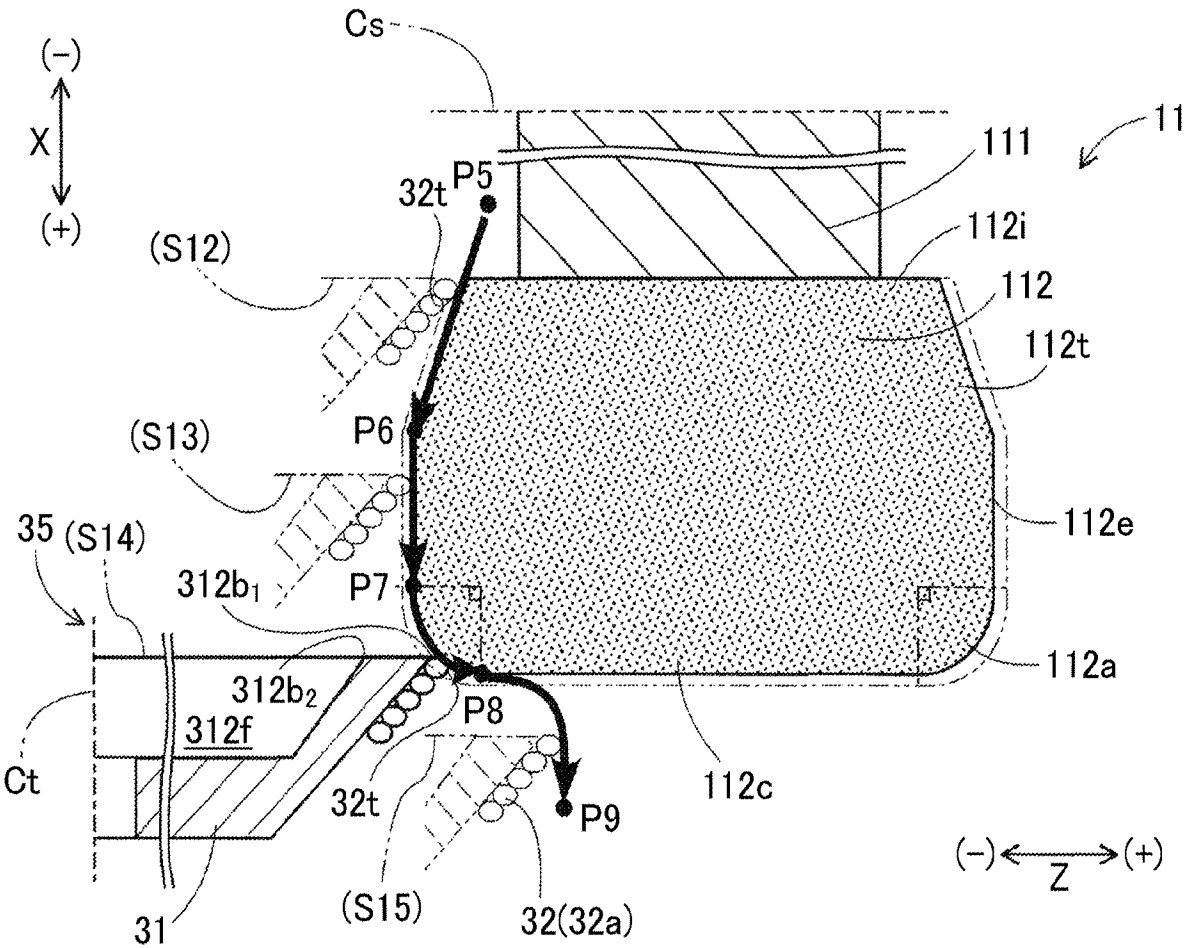
FIG. 8 is a diagram illustrating how the truer moves relative to the grinding wheel during the second process.

The second process to be performed by the controller 40 will be described below with reference to FIGS. 7 and 8. With the grinding wheel 11 and the truer 35 rotated, the controller 40 causes the truer 35 to move relative to the grinding wheel 11 so that the truer 35 faces the other one of the end faces 112*e* of the grinding wheel 11. In step S11, the controller 40 causes the extremity portion 32*t* of the abrasive grain layer 32 to move relative to the grinding wheel 11 so that the extremity portion 32*t* comes to a position P5 illustrated in FIG. 8.

In step S12, the inwardly tapered surface truing control unit 41*t* of the controller 40 causes the extremity portion 32*t* of the abrasive grain layer 32 to move relative to the grinding wheel 11 so that the extremity portion 32*t* moves from the position P5 to a position P6, thus effecting truing on the inwardly tapered surface 112*t*. This step will also be referred to as a "second inwardly tapered surface truing step". In step S13, the end face truing control unit 41*e* of the controller 40 causes the extremity portion 32*t* of the abrasive grain layer 32 to move relative to the grinding wheel 11 so that the extremity portion 32*t* moves from the position P6 to a position P7, thus effecting truing on the end face 112*e*. This step will also be referred to as a "second end face truing step". Shifting the direction of truing after truing on the inwardly tapered surface 112*t* and then effecting truing on the end face 112*e* may involve adjusting the direction of movement of the extremity portion 32*t* of the abrasive grain layer 32. In step S14, the corner truing control unit 41*a* of the controller 40 causes the extremity portion 32*t* of the abrasive grain layer 32 to move relative to the grinding wheel 11 so that the extremity portion 32*t* moves from the position P7 to a position P8, thus effecting truing on the corner 112*a*. This step will also be referred to as a "second corner truing step".

In step S15, the controller 40 causes the extremity portion 32*t* of the abrasive grain layer 32 to move relative to the grinding wheel 11 so that the extremity portion 32*t* moves from the position P8 to a position 9, thus allowing the extremity portion 32*t* of the abrasive grain layer 32 to move away from the outer peripheral cylindrical surface 112*c* without effecting truing on the outer peripheral cylindrical surface 112*c*. In this operation, the extremity portion 32*t* of the abrasive grain layer 32 first starts moving along a tangent to the corner 112*a* from the position P8 and then moves along an arc, so that the extremity portion 32*t* moves away from the outer peripheral cylindrical surface 112*c*. Upon completion of these steps, the controller 40 ends the second process.

The truer 35 according to this embodiment includes: the core 31 formed into a truncated cone and rotatable around the center line of the truncated cone (i.e., the rotation axis Ct); and the abrasive grain layer 32 fixed onto the outer peripheral surface 312*d* of the core 31. The truer 35 effects truing on the end faces and outer peripheral surface of the grinding wheel 11. In this embodiment, the end faces and outer peripheral surface of the grinding wheel 11 define the outer surface of the grindstone 112. The outer surface of the grindstone 112 includes the inwardly tapered surfaces 112*t*, the end faces 112*e*, the corners 112*a*, and the outer peripheral cylindrical surface 112*c*. The same goes for the following description. The core 31 of the truer 35 includes: the disc-shaped base 311 that is the small-diameter portion of the truncated cone; and the hollow tubular member 312 including the outer peripheral surface 312*d*. The outer peripheral surface 312*d* extends from the outer peripheral edge of the base 311 in the direction in which the center line of the truncated cone extends (i.e., the rotation axis Ct). The outer peripheral surface 312*d* is tapered so that the extremity 312*b* located opposite to the base 311 is included in the large-diameter portion of the truncated cone. The recess 312*f* opening toward the extremity 312*b* is defined inward of the tubular member 312.

Providing the truncated cone such that the extremity 312*b* of the tubular member 312 is larger in diameter than the base 311 enables the extremity portion 32*t* of the abrasive grain layer 32 on the outer peripheral surface 312*d* of the tubular member 312 to effect truing on the end faces and outer peripheral surface of the grinding wheel 11. In other words, this embodiment enables the single truer 35 to effect truing on the end faces and outer peripheral surface of the grinding wheel 11.

The tubular member 312 has a hollow tubular shape. The tubular member 312 extends from the outer peripheral edge of the base 311 in the direction in which the center line of the truncated cone extends. Thus, the recess 312*f* opening toward the extremity 312*b* of the core 31 is defined inward of the tubular member 312. The extremity 312*b* of the tubular member 312 defining the end surface of the core 31 has a substantially annular shape surrounding the recess 312*f*. Because the extremity 312*b* of the tubular member 312 to be brought into contact with the end face(s) 112*e*, the corner(s) 112*a*, and/or the outer peripheral cylindrical surface 112*c* of the grinding wheel 11 has the substantially annular shape, the area of contact of the end surface of the core 31 with the grinding wheel 11 is smaller than the area of contact of the end surface of a conventional core with a grinding wheel. This reduces resistance during truing on the end face(s) 112*e*, the corner(s) 112*a*, and/or the outer peripheral cylindrical surface 112*c* of the grinding wheel 11. Consequently, a defective condition, such as deviation of the abrasive grains 32*a* from the desired positions on the outer peripheral cylindrical surface 112*c* of the grinding wheel 11, is unlikely to occur, thus further facilitating accuracy control over truing.

In this embodiment, the radial thickness Tb of the extremity 312*b* of the tubular member 312 is larger than the radial thickness Ta of the base portion 312*a* of the tubular member 312. The base portion 312*a* of the tubular member 312 is integrally fixed to the base 311, so that the extremity 312*b* of the tubular member 312 is a free end. Thus, if the tubular member 312 has a constant thickness, the stiffness of the tubular member 312 is likely to decrease as the tubular member 312 extends to the extremity 312*b*. In this embodiment, however, the thickness of the tubular member 312 increases as the tubular member 312 extends to the extremity 312*b*. Consequently, the tubular member 312 has a substantially constant stiffness from the base portion 312*a* to the extremity 312*b*.

Truing will cause the truer 35 to wear out and will thus reduce the length of the tubular member 312. In the course of truing, however, the tubular member 312 has a substantially constant stiffness, so that the natural frequency of the truer 35 is maintained substantially constant or variation in the natural frequency of the truer 35 is reduced. Thus, the wearing out of the truer 35 will not produce resonance between the natural frequency of the truer 35 and the rotational frequency of the truer 35 or the rotational frequency of the grinding wheel 11. Because such resonance will not be produced, vibrations of the truer 35 during truing are reduced. Consequently, the accuracy of truing is maintained at a favorable level.

The inside diameter $Ri_1$ of the extremity 312*b* of the tubular member 312 is larger than the width We of the outer peripheral cylindrical surface 112*c* of the grinding wheel 11. Thus, when the extremity portion 32*t* of the abrasive grain layer 32 effects truing on the outer peripheral cylindrical surface 112*c*, a portion of the outer peripheral cylindrical surface 112*c* after being subjected to truing faces the recess 312*f* during movement of the extremity 312*b* of the tubular member 312 across the entire width of the outer peripheral cylindrical surface 112*c*. The portion of the outer peripheral cylindrical surface 112*c* after being subjected to truing is prevented from coming into contact with a portion of the tubular member 312 rearward of the extremity 312*b* in the direction of movement. Consequently, resistance during truing is reduced with more reliability.

The inside diameter $Ri_g$ of the base portion 312*a* of the tubular member 312 is larger than the width Wc of the outer peripheral cylindrical surface 112*c* of the grinding wheel 11. Thus, the wearing out of the tubular member 312 will not bring the portion of the outer peripheral cylindrical surface 112*c* after being subjected to truing into contact with the portion of the tubular member 312 rearward of the extremity 312*b* in the direction of movement. Consequently, if the tubular member 312 wears out, resistance during truing would be reduced with more reliability.

The radial thickness Tb of the extremity 312*b* of the tubular member 312 is smaller than the width Wc of the outer peripheral cylindrical surface 112*c* of the grinding wheel 11. Thus, when the extremity portion 32*t* of the abrasive grain layer 32 effects truing on the outer peripheral cylindrical surface 112*c*, the extremity 312*b* of the tubular member 312 comes into contact with only a portion of the outer peripheral cylindrical surface 112*c* of the grinding wheel 11. Consequently, resistance during truing is reduced with more reliability.

The radial thickness Tb of the extremity 312*b* of the tubular member 312 is larger than the radial thickness Ta of the base portion 312*a* of the tubular member 312. The radial thickness Ta of the base portion 312*a* of the tubular member 312 is smaller than the width We of the outer peripheral cylindrical surface 112*c* of the grinding wheel 11. Thus, if the tubular member 312 wears out, the extremity 312*b* of the tubular member 312 would always come into contact with only a portion of the outer peripheral cylindrical surface 112*c* of the grinding wheel 11. Consequently, if the tubular member 312 wears out, resistance during truing would be reduced with more reliability.

The abrasive grain layer 32 has the predetermined width Wd from the extremity 312*b* of the tubular member 312 toward the center line of the core 31 (i.e., the rotation axis Ct). The depth D of the recess 312*f* is larger than the predetermined width Wd. If the abrasive grain layer 32 and the tubular member 312 wear out, the recess 312*f* would inevitably be present in an area adjacent to the abrasive grain layer 32. This means that resistance during truing is reliably reduced in the area adjacent to the abrasive grain layer 32.

The truing apparatus T functioning as part of the grinder 1 includes: the truer 35; the X-axis driving device 19 to move the grinding wheel 11 relative to the truer 35 along the X-axis; the Z-axis driving device 29 to move the truer 35 relative to the grinding wheel 11 along the Z-axis; and the controller 40 to control the X-axis driving device 19 and the Z-axis driving device 29.

The controller 40 includes the end face truing control unit 41*e*. The controller 40 causes the truer 35 and the grinding wheel 11 to assume such relative positions that the rotation axis Ct of the truer 35 is perpendicular to the rotation axis Cs of the grinding wheel 11, and the extremity 312*b* of the tubular member 312 faces toward the rotation axis Cs of the grinding wheel 11. In this state, the end face truing control unit 41*e* causes the truer 35 to move relative to the grinding wheel 11 so that the truer 35 moves in the radially outward direction of the grinding wheel 11 (or moves to the position P2), thus effecting truing on the end face 112*e* of the grinding wheel 11.

The controller 40 further includes the outer peripheral cylindrical surface truing control unit 41*c*. After the process step (i.e., step S4) performed by the end face truing control unit 41*e*, the outer peripheral cylindrical surface truing control unit 41*c* causes the truer 35 to move relative to the grinding wheel 11 so that the truer 35 moves in parallel with the rotation axis Cs of the grinding wheel 11 (or moves to the position P4). Thus, the truer 35 effects truing on the outer peripheral cylindrical surface 112*c* while contact of the outer peripheral edge $312b_1$ of the extremity 312*b* of the tubular member 312 with the outer peripheral cylindrical surface 112*c* precedes contact of the inner peripheral edge $312b_2$ of the extremity 312*b* of the tubular member 312 with the outer peripheral cylindrical surface 112*c*.

Suppose that a truing method according to an embodiment of the invention is to be performed by the end face truing control unit 41*e* and the outer peripheral cylindrical surface truing control unit 41*c* of the controller 40. In this case, the truing method includes the first end face truing step (i.e., step S4) and the outer peripheral cylindrical surface truing step (i.e., step S6).

The truing apparatus T, the grinder 1, and the truing method exert a force on the abrasive grains 32*a* in a radially inward direction of the truer 35. This force makes it difficult for the abrasive grains 32*a* to be separated from the core 31. Thus, the truing apparatus T, the grinder 1, and the truing method not only enhance the accuracy of shaping of the grinding wheel 11 by truing but also increase the life of the truer 35. The truer 35 effects truing without changing the direction of the rotation axis Ct of the truer 35. In other words, the truer 35 effects truing, with the rotation axis Ct of the truer 35 kept perpendicular to the rotation axis Cs of the grinding wheel 11. This results in an increase in operating efficiency.

The grinding wheel 11 includes the corners 112*a* each defining a portion of the outer peripheral surface of the grinding wheel 11. Each corner 112*a* connects the outer peripheral cylindrical surface 112*c* with the associated end face 112*e*. The controller 40 further includes the corner truing control unit 41*a*. Following the process step (i.e., step S4) performed by the end face truing control unit 41*e*, the corner truing control unit 41*a* causes the truer 35 to move relative to the grinding wheel 11 so that the truer 35 moves along the corner 112*a*, thus effecting truing on the corner 112*a*. Following the process step (i.e., step S5) performed by the corner truing control unit 41*a*, the outer peripheral cylindrical surface truing control unit 41*c* effects truing on the outer peripheral cylindrical surface 112*c* (step S6).

As just described, the truer 35 effects truing on the end face 112*e*, the corner 112*a*, and the outer peripheral cylindrical surface 112*c* in this order. The truer 35 is moved relative to the grinding wheel 11 so that the truer 35 effects truing in this order. Thus, similarly to truing on the outer peripheral cylindrical surface 112*c*, truing on the corner 112*a* is unlikely to cause the abrasive grains 32*a* of the abrasive grain layer 32 to be separated from the core 31. Consequently, this embodiment of the invention not only enhances the accuracy of shaping of the grinding wheel 11 by truing but also increases the life of the truer 35.

What is claimed is:

1. A truer that effects truing on an end face and an outer peripheral surface of a grinding wheel, the truer comprising:

a core formed into a truncated cone, the core being rotatable around a center line of the truncated cone; and an abrasive grain layer fixed onto an outer peripheral surface of the core, wherein the core includes a base that is a small-diameter portion of the truncated cone, the base having a disc shape, and a tubular member extending from an outer peripheral edge of the base in the direction in which the center line of the truncated cone extends, the tubular member having a hollow tubular shape, the tubular member includes an outer peripheral surface tapered so that a portion of the tubular member opposite to the base and adjacent to an extremity of the tubular member is a large-diameter portion of the truncated cone, and a recess opening toward the extremity is defined inward of the tubular member.

2. The truer according to claim 1, wherein a radial thickness of the extremity of the tubular member is larger than a radial thickness of a portion of the tubular member on the base side.

3. The truer according to claim 1, wherein an inside diameter of the extremity of the tubular member is larger than a width of an outer peripheral cylindrical surface of the grinding wheel.

4. The truer according to claim 1, wherein a radial thickness of the extremity of the tubular member is smaller than a width of an outer peripheral cylindrical surface of the grinding wheel.

5. The truer according to claim 1, wherein the abrasive grain layer is formed across a predetermined width so that the abrasive grain layer extends along the outer peripheral surface of the tubular member from the extremity of the tubular member toward the center line of the truncated cone, and the recess has a depth larger than the predetermined width.

6. A truing apparatus comprising:

the truer according to claim 1;

a mover to move the truer and the grinding wheel relative to each other; and a controller to control the mover, wherein the controller causes the truer and the grinding wheel to have such relative positions that a rotation axis of the truer is perpendicular to a rotation axis of the grinding wheel, and the extremity of the tubular member faces toward the rotation axis of the grinding wheel, the controller includes an end face truing control unit to move the truer relative to the grinding wheel so that the truer moves in a radially outward direction of the grinding wheel, thus effecting truing on the end face of the grinding wheel, and an outer peripheral cylindrical surface truing control unit to move the truer relative to the grinding wheel so that the truer moves in parallel with the rotation axis of the grinding wheel, thus effecting truing on an outer peripheral cylindrical surface of the grinding wheel while contact of an outer peripheral edge of the extremity of the tubular member with the outer peripheral cylindrical surface of the grinding wheel precedes contact of an inner peripheral edge of the extremity of the tubular member with the outer peripheral cylindrical surface of the grinding wheel, the truing on the outer peripheral cylindrical surface of the grinding wheel being effected after the truing on the end face of the grinding wheel.

7. The truing apparatus according to claim 6, wherein the grinding wheel includes a corner defining a portion of the outer peripheral surface of the grinding wheel, the corner connecting the end face with the outer peripheral cylindrical surface of the grinding wheel, the controller further includes a corner truing control unit to move the truer relative to the grinding wheel so that the truer moves along the corner, thus effecting truing on the corner, the truing on the corner follows the truing on the end face of the grinding wheel, and the truing on the outer peripheral cylindrical surface of the grinding wheel follows the truing on the corner.

8. The truing apparatus according to claim 6, wherein the grinding wheel includes an inwardly tapered surface extending from an annular inner peripheral edge of the end face so that the inwardly tapered surface decreases in diameter from the inner peripheral edge of the end face toward the rotation axis of the grinding wheel, the controller further includes an inwardly tapered surface truing control unit to move the truer relative to the grinding wheel so that the truer moves along the inwardly tapered surface, thus effecting truing on the inwardly tapered surface, and the truing on the end face of the grinding wheel is effected after the truing on the inwardly tapered surface.

9. A grinder comprising the truing apparatus according to claim 6.

10. A truing method for effecting truing on an end face of a grinding wheel and an outer peripheral cylindrical surface of the grinding wheel using the truer according to claim 1, the method comprising:

causing the truer and the grinding wheel to have such relative positions that a rotation axis of the truer is perpendicular to a rotation axis of the grinding wheel, and the extremity of the tubular member faces toward the rotation axis of the grinding wheel;

moving the truer relative to the grinding wheel so that the truer moves in a radially outward direction of the grinding wheel, thus effecting truing on the end face of the grinding wheel; and moving the truer relative to the grinding wheel so that the truer moves in parallel with the rotation axis of the grinding wheel, thus effecting truing on the outer peripheral cylindrical surface of the grinding wheel while contact of an outer peripheral edge of the extremity of the tubular member with the outer peripheral cylindrical surface of the grinding wheel precedes contact of an inner peripheral edge of the extremity of the tubular member with the outer peripheral cylindrical surface of the grinding wheel, the truing on the outer peripheral cylindrical surface of the grinding wheel being effected after the truing on the end face of the grinding wheel.

* * * * *